US005582025A

United States Patent [19]

Dubin et al.

[11] Patent Number: 5,582,025

[45] Date of Patent: Dec. 10, 1996

[54] LOW OBSTRUCTION WINDOW AIR CONDITIONER

[75] Inventors: Melvin Dubin, Great Neck; Jack Kayne, Kings Park, both of N.Y.

[73] Assignee: Slant/Fin Corporation, Greenvale, N.Y.

[21] Appl. No.: 493,254

[22] Filed: Jun. 21, 1995

[51] Int. Cl.[6] ..... F25D 23/12; F25D 19/00; F16M 13/00

[52] U.S. Cl. ..... 62/262; 62/298; 248/544; 248/657

[58] Field of Search ..... 62/262, 263, 298, 62/302, 297; 248/544, 651, 657, 208, 916

[56] References Cited

U.S. PATENT DOCUMENTS

| | | | |
|---|---|---|---|
| 2,320,436 | 6/1943 | Hull | 62/129 |
| 3,151,791 | 10/1964 | Pietsch | 62/262 |
| 3,176,474 | 10/1963 | Abbott | 62/280 |
| 3,296,820 | 1/1967 | Bauman | 62/262 |
| 3,392,546 | 10/1966 | Reed | 62/262 |
| 3,416,329 | 12/1968 | Thomas | 62/262 |
| 3,448,590 | 6/1969 | Eberhart | 62/262 |
| 3,491,549 | 1/1970 | Oglesby | 62/262 |
| 3,554,476 | 1/1971 | Gaylor | 248/208 |
| 3,861,283 | 1/1975 | Shaner | 62/262 |
| 3,884,048 | 5/1975 | Schneider | 62/298 |
| 5,027,614 | 7/1991 | Mori et al. | 62/262 |
| 5,167,131 | 12/1992 | Karkhanis | 62/262 |
| 5,253,485 | 10/1993 | Kennedy | 62/262 |

*Primary Examiner*—William Doerrler
*Attorney, Agent, or Firm*—Herbert Dubno

[57] ABSTRACT

A low obstruction window air conditioner has a platform on an outer member of its sill straddling bracket so that a jack screw can raise or lower the platform and the outer unit containing the compressor, the condenser coil, the fan (driven by a motor) and a condensate pump. Once in position, the inner unit is suspended from a pair of bars inserted through the bracket into the outer unit.

9 Claims, 11 Drawing Sheets

LOW OBSTRUCTION WINDOW AIR CONDITIONER

FIELD OF THE INVENTION

Our present invention relates to a low-obstruction window air conditioner and, more particularly, to the type of air conditioner which straddles a windowsill so that the compressor unit is located along an outside wall generally below the windowsill while the evaporator and air circulator are disposed in an interior unit lying generally below the windowsill along the interior side of the wall.

BACKGROUND OF THE INVENTION

Low obstruction air conditioners of that type, which straddle the windowsill, allow a lower sash of the window to closely approach the windowsill and thereby do not materially obstruct the view through the window or light and air from the window. The low obstruction window air conditioner has an advantage over units which occupy the bulk of the opening for the lower sash in that the window remains usable.

In U.S. Pat. 5,167,131, for example, such a low obstruction air conditioner is described in which the outer unit contains the compressor, condenser coil and fan while the inner unit contains the evaporator and the air circulator and the inner and outer units are connected by a bracket which rests upon the sill. The bracket is comparatively massive and allows the tubes connecting the two units to pass through it. The units themselves are braced against the inner and outer sides of the wall.

A similar air conditioner is disclosed in U.S. Pat. No. 2,320,436. A low profile air conditioning unit is also described in U.S. Pat. No. 3,416,329 and still another unit of the general type straddling the windowsill can be found in U.S. Pat. No. 3,176,474. Mention may also be made of U.S. Pat. No. 5,253,485, 3,392,546, 3,296,820 and 3,448,590, all of which disclose split air conditioning units, namely units in which an outer housing contains the compressor, condenser coil and fan and the inner unit contains an air circulating blower. U.S. Pat. No. 3,554,496 deals with problems involved in the mounting of window air conditioners.

The prior art described above is characterized by the problem of having to mount a relatively heavy structure along the exterior of the building through the window opening. In other words, there is a significant problem with all of these earlier systems in mounting the heaviest portion of the air conditioner, namely, the outer unit, upon the exterior when access is available only through the window opening.

OBJECTS OF THE INVENTION

It is the principal object of the present invention, therefore, to provide an improved low-profile and low obstruction split window air conditioner which avoids drawbacks of earlier air conditioning systems.

Another object of the invention is to provide a low obstruction window air conditioner which can be mounted more easily with less strain than earlier air conditioner units.

Still another object of the invention is to provide a modular type air conditioning unit which is more stable than earlier units, more readily disassembled for repair and replacement and which, in general, is more easily handled.

SUMMARY OF THE INVENTION

These objects and others which will become more readily apparent hereinafter are attained, in accordance with the invention, with an air conditioner bracket which straddles the windowsill and preferably is itself not adjustable for windowsills of various width but which has a fixed width horizontal member, the brackets being provided in various sizes with the smallest bracket being used which will fit over the sill. By eliminating the need for adjustable brackets, the stability of the bracket and mounting can be greatly enhanced.

According to the invention, an outer member of the bracket which extends downwardly from the horizontal member is provided with a platform which can be raised and lowered by a jack means while the bracket is provided with channels guiding the outer unit onto this platform so that the outer unit can be lowered utilizing the mechanical advantage of the jack means until the outer unit is in the operating position.

Not only does the jack means allow precise lowering of the outer unit without strain upon the installer, but by reverse operation of the jack means, servicing personnel can raise the operating unit into a position into which it can be tilted downwardly and slid out of its guides on the horizontal member of the bracket much like a drawer is withdrawn from its slides.

Once the outer unit is disposed in its operating position, a pair of bars are inserted into the upper member of the bracket and into the casing of the outer member so that the weight of the outer member can be taken up at least in part by the bars which also project inwardly beyond the inner member of the bracket so that the inner unit can be mounted thereon.

In practice, therefore, installation of the air conditioner is comparatively quick. Once the saddle shaped bracket is placed over the sill, levelled and anchored in place, the outer unit is slid along the guide of the horizontal member and the outer vertical member of the bracket and swung into the vertical position on the platform. The latter is lowered by the jack means and is held in the operating position by insertion of the bars upon which the inner unit is mounted. The tubes are then connected to the two units and lie along the horizontal member which can be covered by a cover plate. For disassembly a reverse procedure is employed, i.e. the cover plate is removed, the tubes are disconnected, the inner unit is dismounted, the bars are withdrawn, the platform mechanically raised by the jack means and the outer unit tilted to lie horizontally and then withdrawn along the horizontal guide channels.

More particularly, a low obstruction window air conditioner of the window can comprise:

a saddle bracket adapted to straddle the sill and provided with a substantially horizontal member adapted to rest upon the sill, an outer member extending downwardly from the horizontal member along an exterior of the wall, an inner member extending downwardly from the horizontal member along an interior of the wall, a raisable and lowerable platform guided on the outer member, and jack means operable for raising and lowering the platform on the outer member;

an outer unit comprising an outer casing, a compressor in the outer casing, a condenser in the outer casing a condensate pump in the outer casing and a condenser fan (driven by a motor) in the outer casing, the outer unit being provided with guide means cooperating with guide means on the bracket for guiding the unit onto the platform in a raised position of the platform, whereby operation of the jack means lowers the platform with the outer unit thereon into an operating position of the outer unit;

an inner unit mounted on the bracket and disposed along the inner member, the inner unit comprising an evaporator and a blower (driven by a motor) for blowing air into the interior upon cooling of the air in the evaporator; and refrigerant tubes disposed in the horizontal member and connecting the units.

Alternatively it can comprise:

a saddle bracket adapted to straddle the sill and provided with a substantially horizontal member adapted to rest upon the sill, an outer member extending downwardly from the horizontal member along an exterior of the wall, and an inner member extending downwardly from the horizontal member along an interior of the wall;

a pair of bars removably fitted into the horizontal member, engaging an upper side of the outer casing in an operative position of the outer casing to secure the outer unit in the operating position, and projecting into the interior beyond the inner member;

an inner unit disposed along the inner member, the inner unit comprising guides slidably received on the bars for removably suspending the inner unit from the bars, an evaporator and a blower for blowing air into the interior upon cooling of the air in the evaporator; and refrigerant tubes disposed in the horizontal member and connecting the units.

According to the invention the guide means on the outer unit includes rollers provided on the outer casing and the guide means on the bracket include horizontal channels on the horizontal member and vertical channels on the outer member receiving the rollers.

The jack means can include a vertical jack screw receiving a hexagonal key, i.e. an Allen key, at its upper end.

Bracing screws can be provided on the inner and outer members of the bracket for bracing same against the wall and a levelling screw can be provided on the horizontal member for levelling same.

A condensate collector and float level switch can be provided below the evaporator and connected with the outer unit by a condensate tube extending through the horizontal member. Preferably the bars are of tubular and rectangular cross section, usually square cross section.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
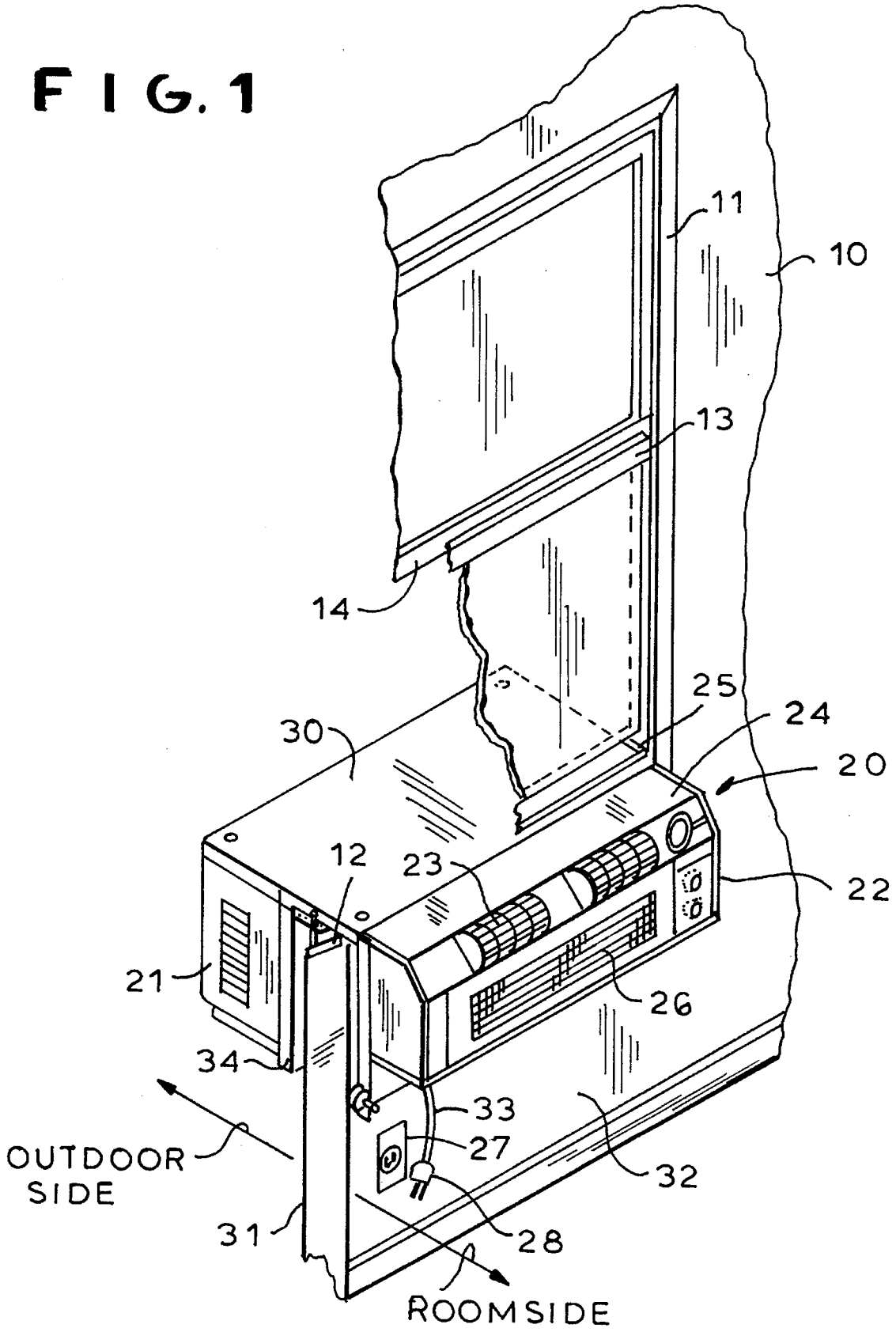
FIG. 1 is a perspective view of a low obstruction window air conditioner shown in place in a window opening of a structure, the window being broken away.

In FIG. 1, we have shown a wall 10 provided with a window frame 11 with a sill 12, an upper sash 14 and a lower sash 15, the latter being closed onto a seal 25 against a cover plate 30 of the low obstruction air conditioner 20 straddling this sill.

The wall 10 has an external surface 31 below the sill and an internal surface 32 on the outdoor side and the room side, respectively. The room side wall surface 32 is provided with an outlet 27 into which the plug 28 of the electrical cord 33 of the air conditioner can be inserted.

The air conditioner 20 has a bracket 34 which will be described in greater detail subsequently and which straddles the sill. On the outside of that bracket, the air conditioner 20 comprises an outer unit 21 and on the inside of the bracket 34, an inner unit 22. The outer unit contains the compressor, the condenser coil and the fan (driven by a motor 101) for dissipating heat and condensate from the condenser coil. The outer unit also contains a condensate suction pump 102 drawing condensate via tube 80 from the condensate pan below the evaporator coil. The inner unit 22 comprises an air circulating blower (driven by a motor 77) and the evaporator coil. The cover 30 is flush with a platform 24 of the inner unit 22 which has vents 23 through which the cool air is fed into the room and a lowered vent 26 from which room air is drawn into the unit 22 to be cooled.

As will be apparent from FIG. 1, there is very little height of the bracket 34 above the sill and thus the window is scarcely obstructed at all.

Figure 2:
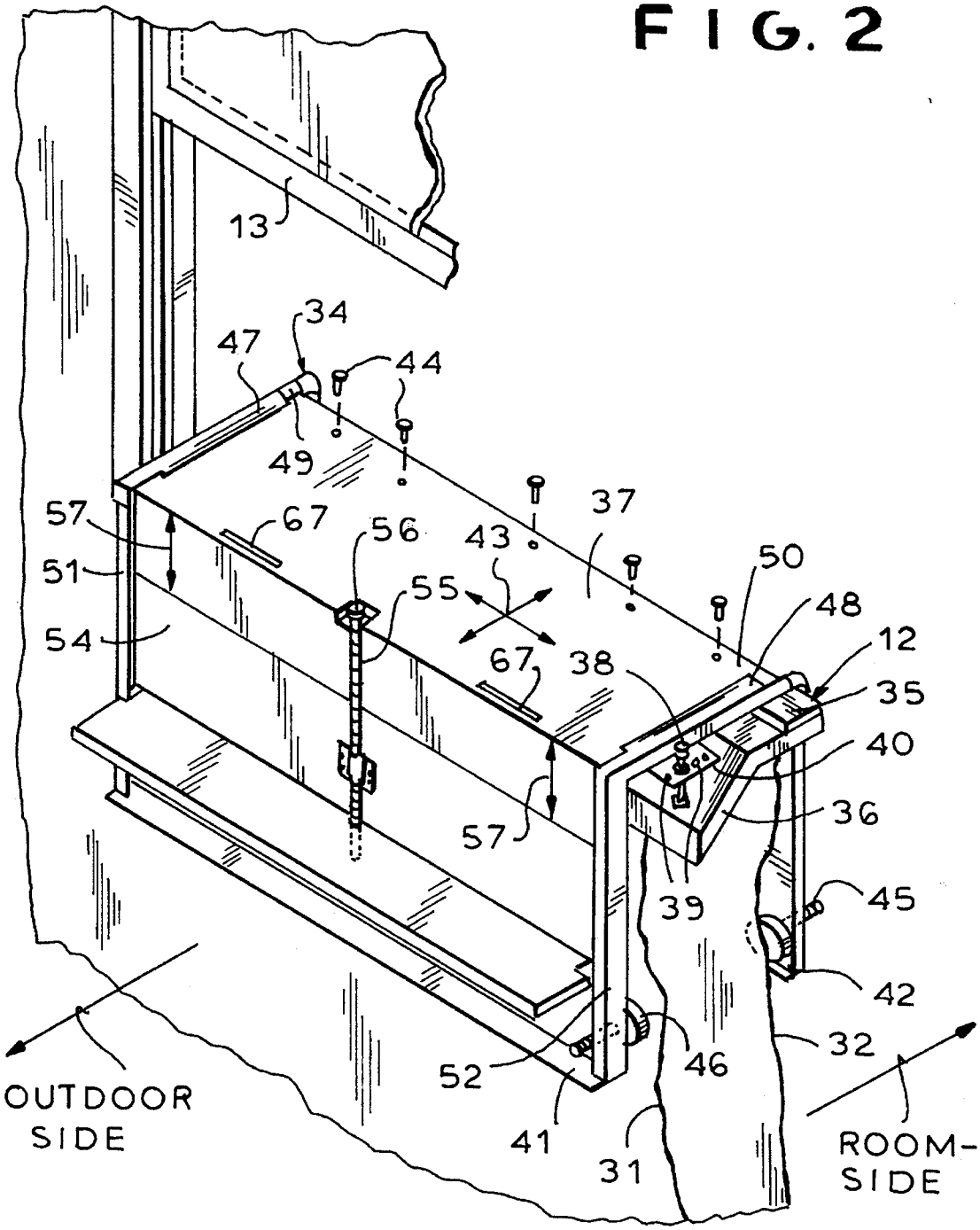
FIG. 2 is a view similar to FIG. 1 but of a somewhat larger scale showing the mounting of the bracket on the window-sill.

Turning now to FIG. 2 in which the bracket 34 on the sill 12 is shown in greater detail, the inner sill is represented at 35 and the outer sill at 36.

The bracket 34 comprises a horizontal member 37 which overlies the sill 12 and is levelled with respect to it by one or more levellers 38 in the form of screws which can be inserted in selected holes 39 of a leveller bracket 40.

The saddle bracket 34 is formed in one piece with the horizontal member 37 and an outer vertical member 41 and an inner vertical member 42 juxtaposed with the wall surfaces 31 and 32 previously mentioned.

The bracket is not adjustable for the width of the sill and indeed a selection of fixed-size brackets is provided with the smallest bracket width being selected which will straddle the sill.

The arrows 43 represent levelling of the bracket in all directions before the screws 44 are inserted to fasten the bracket 34 to the sill. Prior to this fastening, two inner adjusting screws 45 and two outer adjusting screws 46 are brought to bear against the wall surfaces 31 and 32 so that the bracket 34 is snugly held in place.

The bracket 34 also comprises a pair of inwardly open channels 47 and 48 which are cut away at 49 and 50 to receive the rollers of the outer member which can be guided along the channels 47 and 48 to a pair of connecting vertical channels 51 and 52.

The vertical member 41 also has a platform 53 whose back 54 is connected to a jack screw 55 with an Allen wrench head 56 and which serves to raise and lower the platform as represented by the arrows 57.

Figure 3:
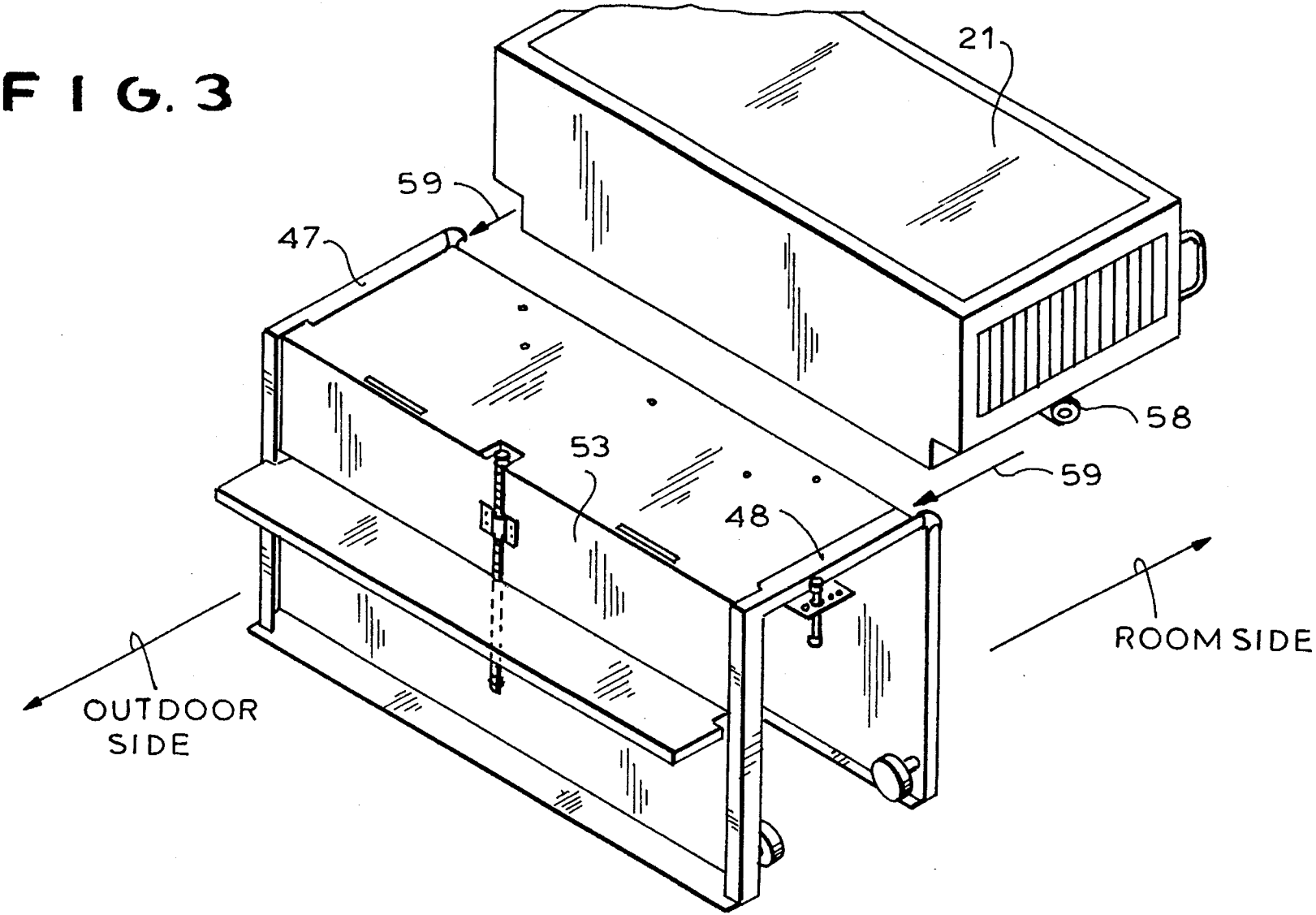
FIG. 3 is a perspective view without the window diagrammatically illustrating the insertion of the outer unit into the horizontal guides.
Figure 4:
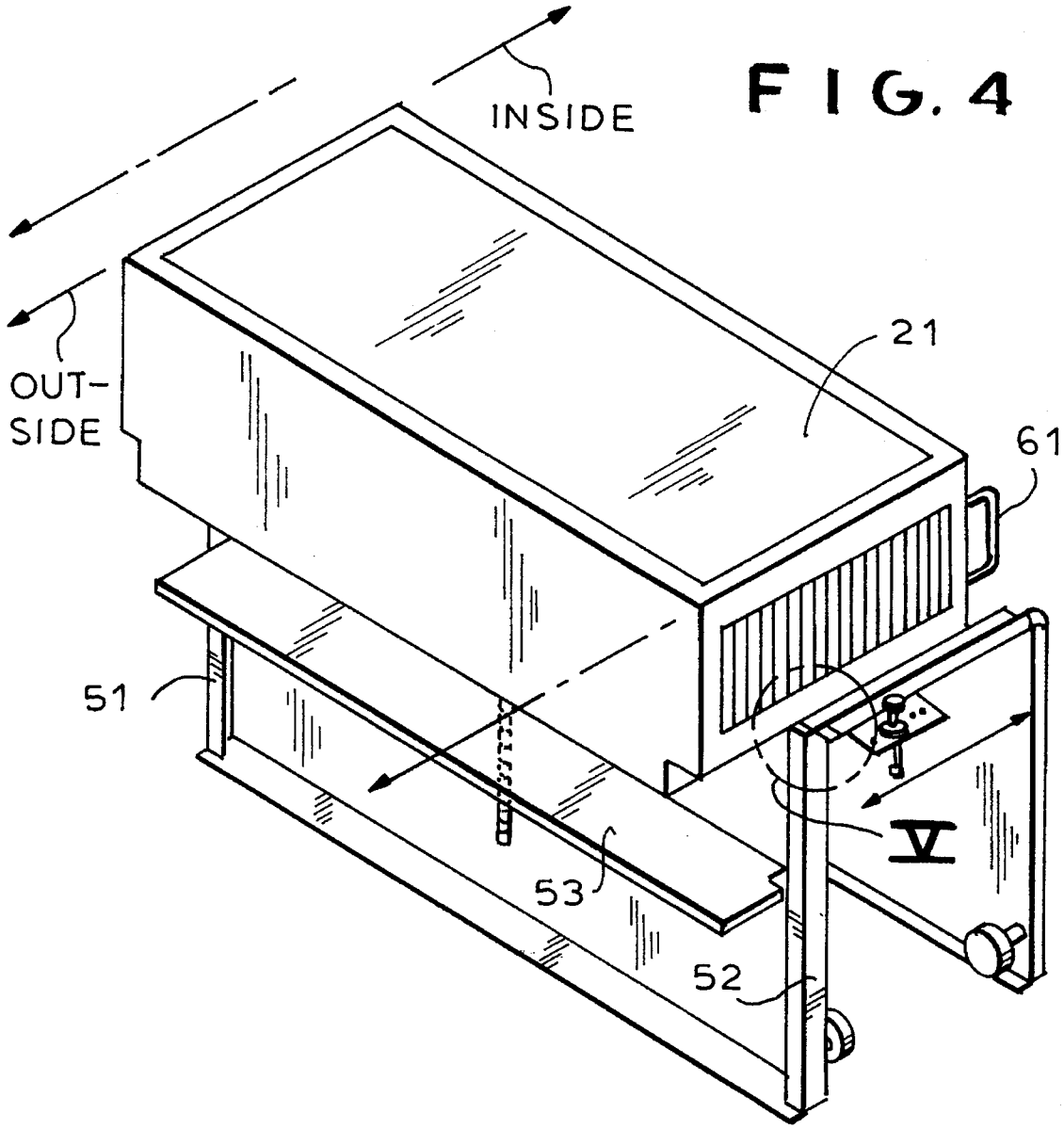
FIG. 4 is similar to FIG. 3 showing the outer unit in its position just before it is tilted vertically onto the platform.
Figure 5:
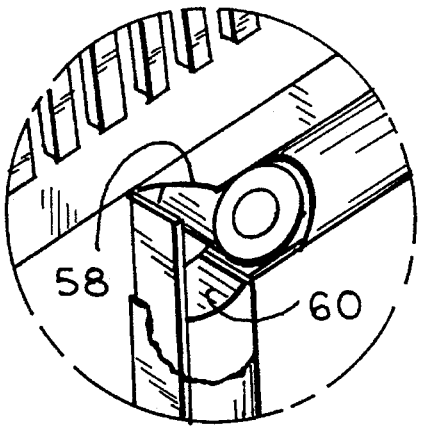
FIG. 5 is a detail of the region V of FIG. 4.

As can be seen from FIG. 3, the outer unit 21 has wheels 58 which are guided in the channels 47 and 48 upon insertion of the outer unit 21 in the direction of arrows 59. During this operation, the platform 53 is in its raised position. FIG. 4 shows the outer unit 21 at the end of its horizontal travel, i.e. with its rollers 58 about to enter the cradle 60 affixed on the back 54 of the platform 53, thereby trapping the rollers 58 in the vertical channels 51 and 52. To facilitate such insertion, the outer unit 21 can be provided with handles 61.

Figure 6:
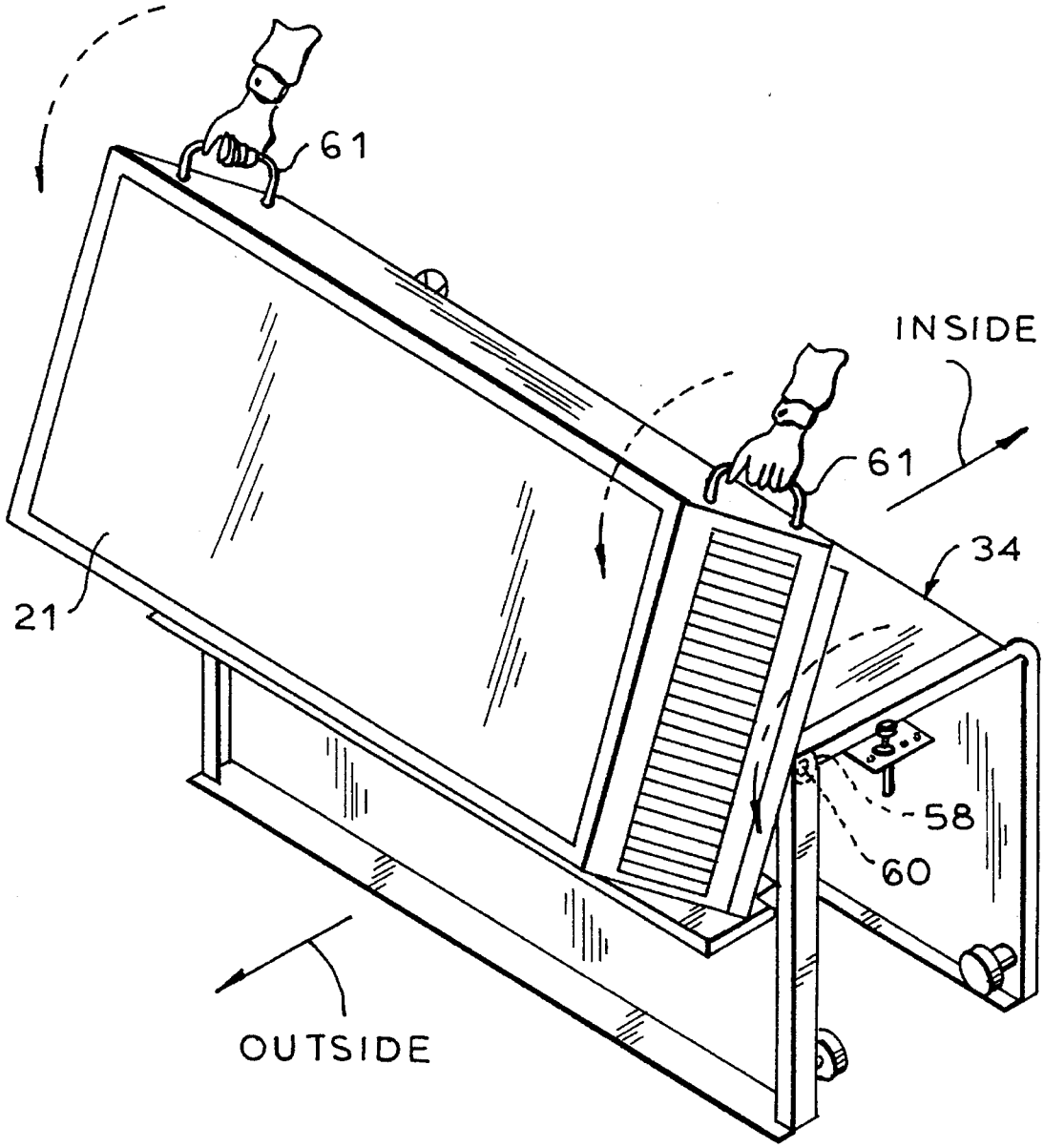
FIG. 6 is a view similar to FIG. 3 showing the tilting operation.
Figure 7:
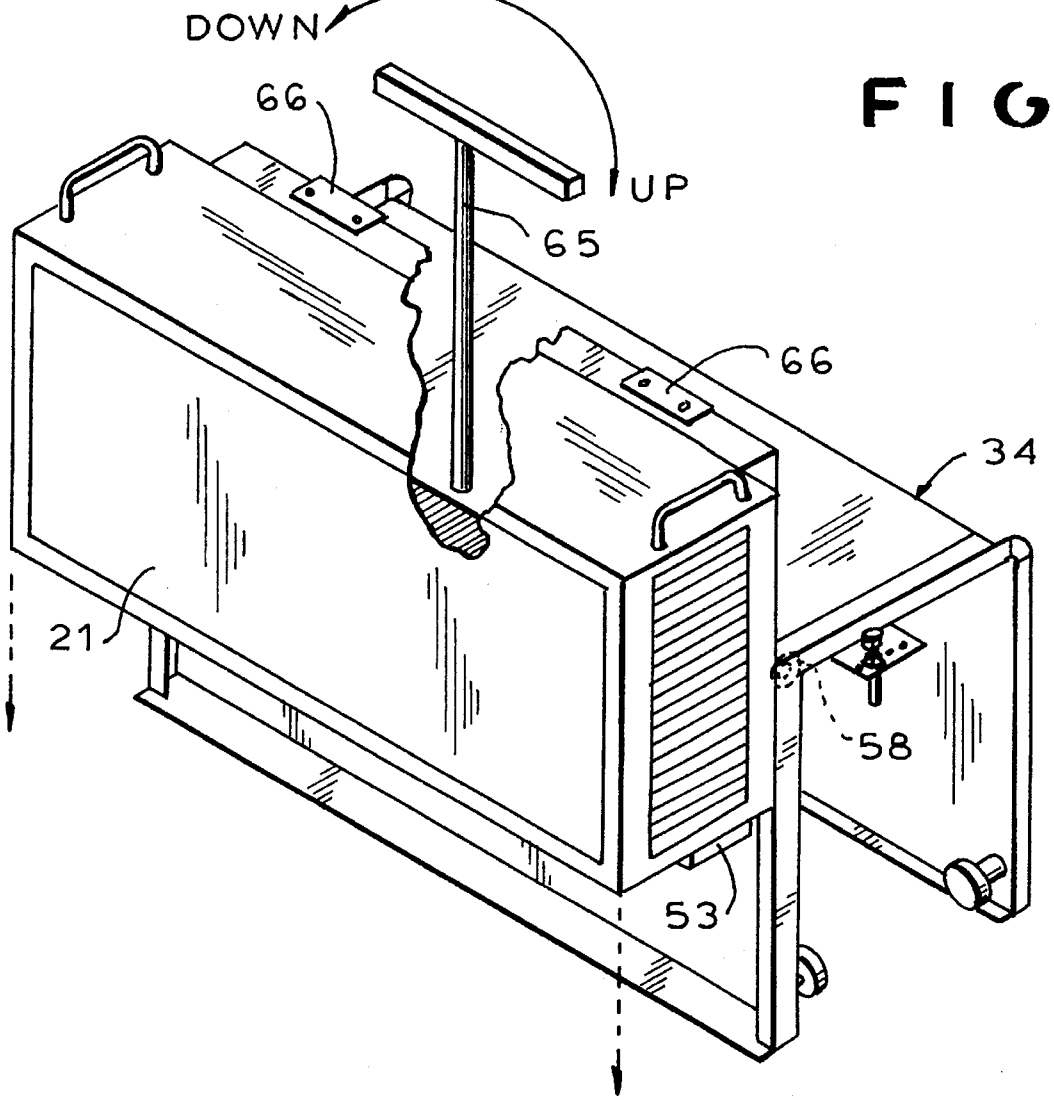
FIG. 7 is another perspective view without the window diagrammatically illustrating the lowering of the outer unit.

As can be seen from FIG. 6, the outer unit 21 is then tilted about wheel axis on the cradle 60. When the outer unit is brought into its vertical position (FIG. 7) resting on the platform 53 with its rollers 58 trapped in the vertical guides 51 and 52, an Allen wrench 65 can be inserted into the head 56 of the jack screw and rotated to lower the platform 53 and the outer unit 21 until the outer unit is in its operative position (FIG. 8), i.e. a pair of support clips 66 have their downwardly turned lips engaged in the slits 67 (FIG. 2) of the bracket 34. Naturally, when the outer unit 21 must be removed for maintenance, the Allen wrench 65 can again be inserted and rotated in the opposite direction to raise the outer unit and allow the latter to be withdrawn in the opposite direction, toward the room side.

Figure 8:
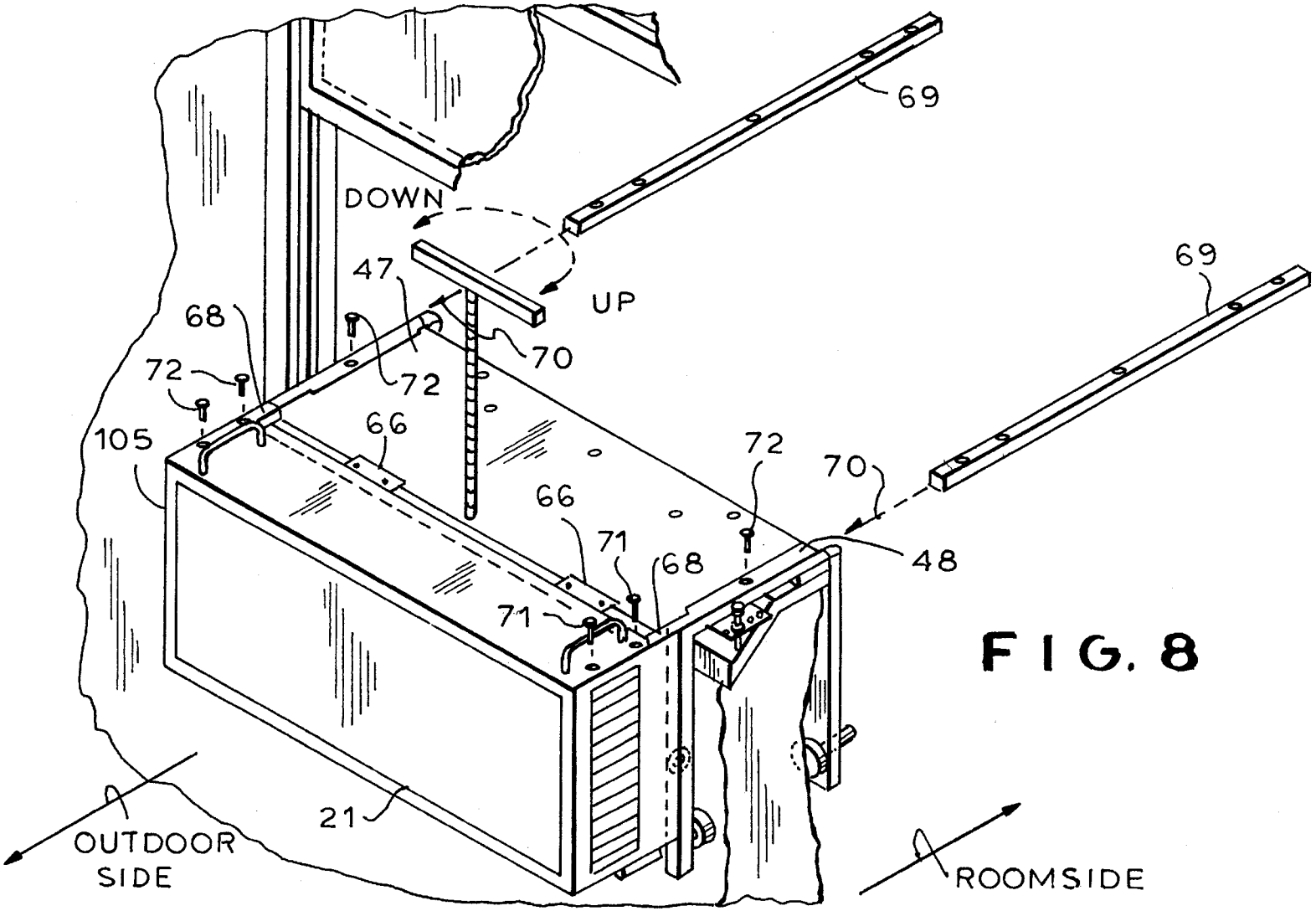
FIG. 8 is a perspective view showing the window in part with the bars about to be inserted.

As can be seen from FIG. 8, once the clips 66 have engaged in the slits 67, guides 68 of the casing 103 of the outer unit 21 are aligned with the channels 47 and 48 so that square-cross section tubular bars 69 can be inserted in the direction of arrows 70 through these channels and into the guides. Screws 71 are then inserted to secure the outer unit 21 to the bars 69 and screws 72 are inserted through the channels 47 and 48 and the bars 69 to secure the bars to the bracket.

Figure 9:
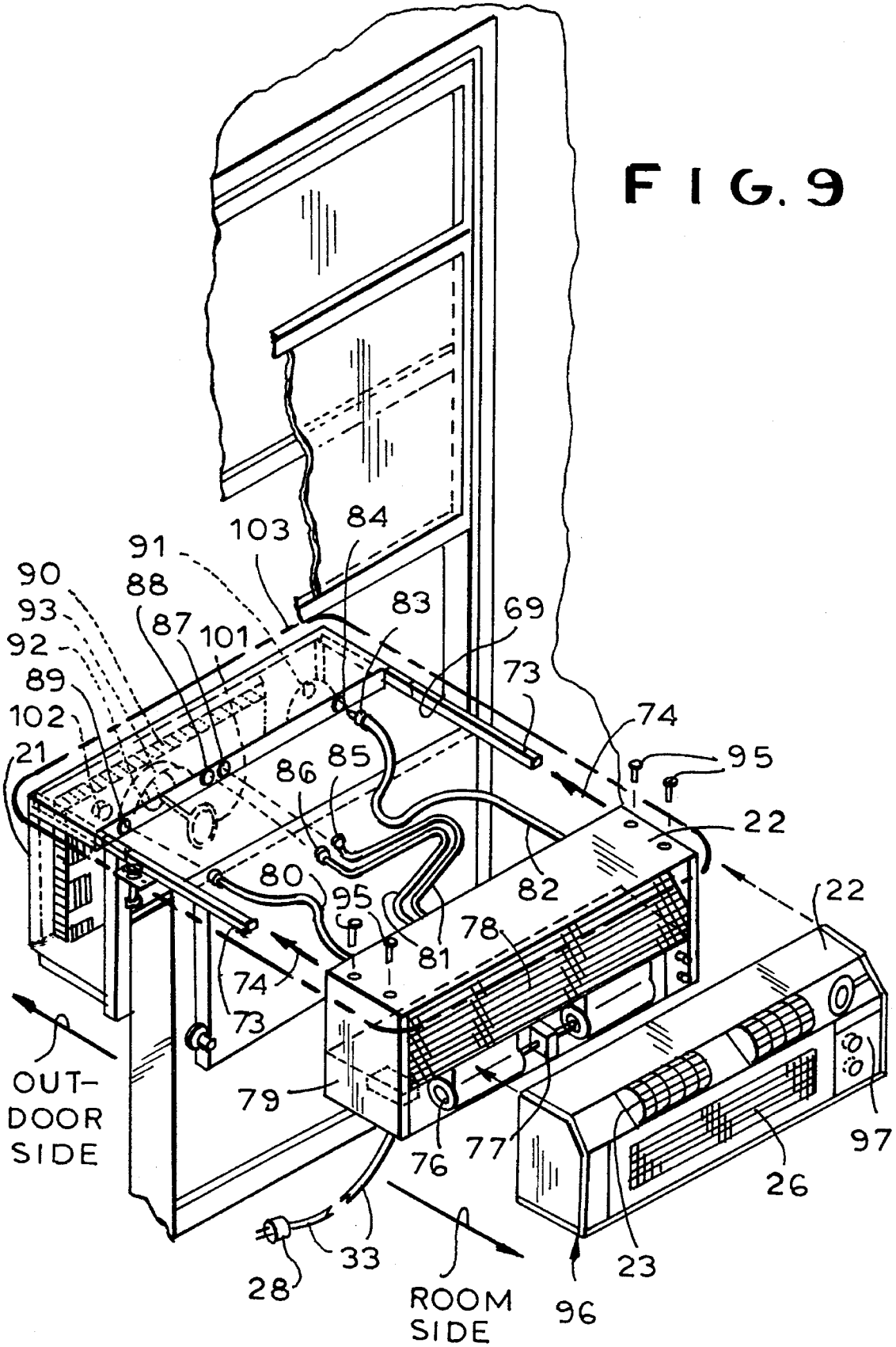
FIG. 9 is a view similar to FIG. 8 illustrating the assembly of the outer unit onto the bars.

From FIG. 9 it will be apparent that ends 73 of the bars 69 project into the room. The inner unit 22 can then be inserted as represented by the arrows 74 onto the bars 69. The room side unit 22 comprises a cooling chassis 75 which is formed with the blower 76 for circulating the room air and driven by a motor 77, and an evaporator coil 78. A condensate pan 79 is provided below the evaporator coil and can be connected by a condensate line 80, to be described in greater detail subsequently, to the outdoor unit 21. The refrigerant tubes 81 have also been shown here diagrammatically and the electric cord 82 which supplies power to the compressor and fan and which controls them has likewise been shown in FIG. 9. The electric cable 82 is provided with a connector 83 mating with the connector 84 on the outer unit 21 and the refrigerant tubes 81 can have connectors 85 and for mating with tubing connectors 87 and 88 of the outer unit. Another connector 89 can be provided for condensate tube 80.

In this figure, as well, the condenser 90, the compressor 91, the fan 92 (driven by a motor) and the fan shroud 93 of the outer unit have been illustrated.

Once the cooling chassis 75 is mounted on the ends 73 of the bars 69, screws 95 can be inserted to connect the chassis to the bar 69. The room side cover 96 can then be snapped onto the chassis 75. The room side cover 96 can have a control panel 95 as is common for such air conditioner, the air inlet grill 26 mentioned earlier, behind which there is an air filter, and the air discharge louvers or grill 23.

Figure 10:
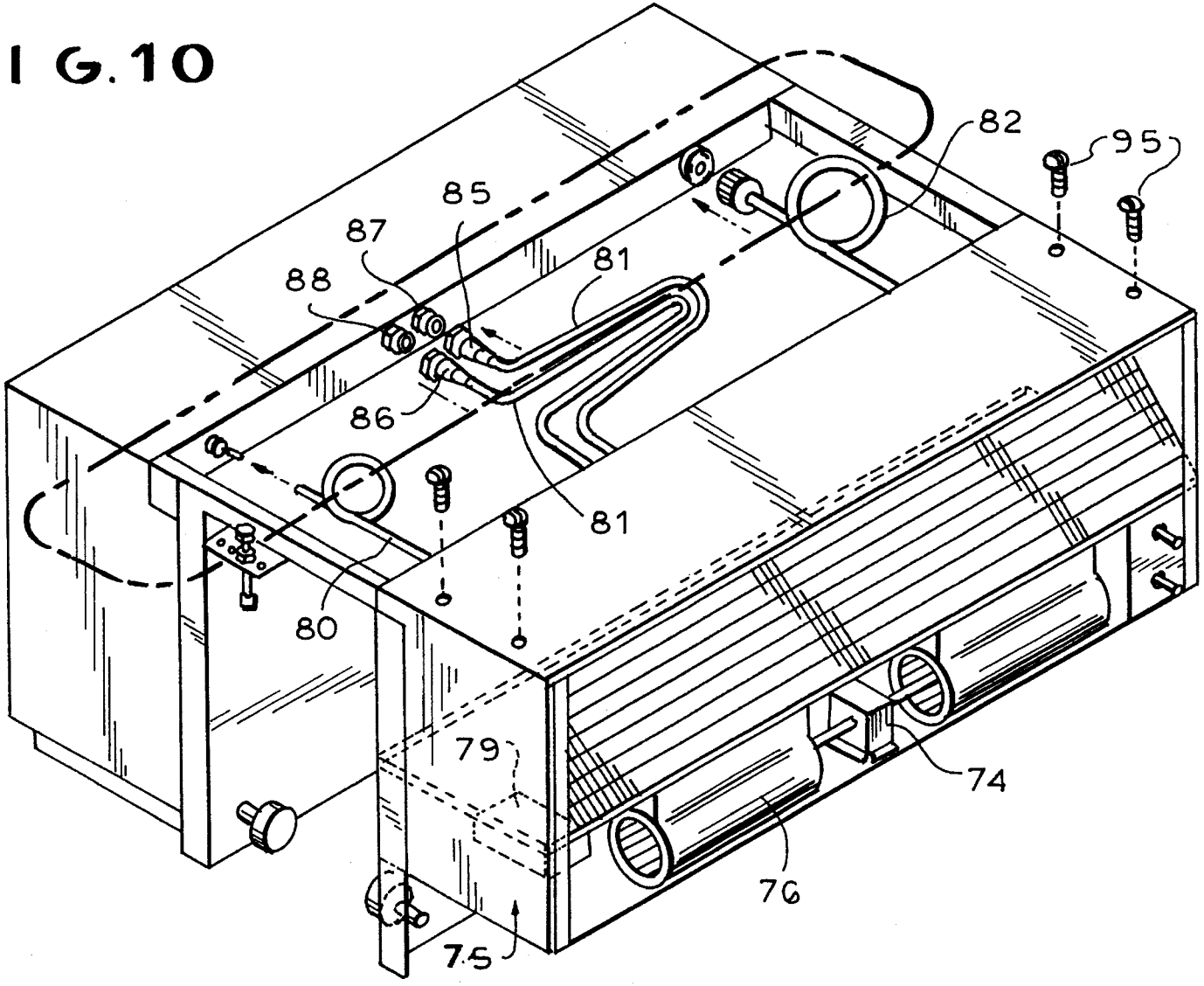
FIG. 10 is an assembly diagram showing the tube connections.
Figure 11:
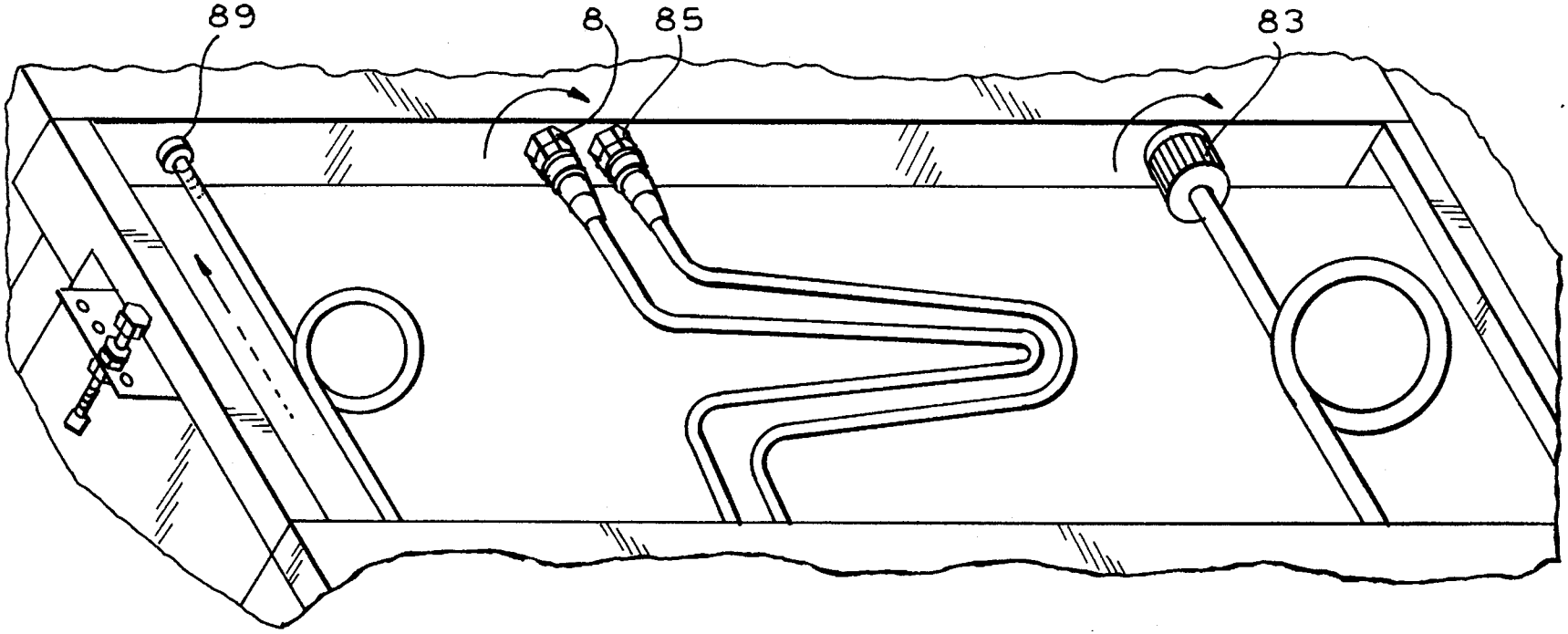
FIG. 11 is a perspective view illustrating the tubes after connection.
Figure 12:
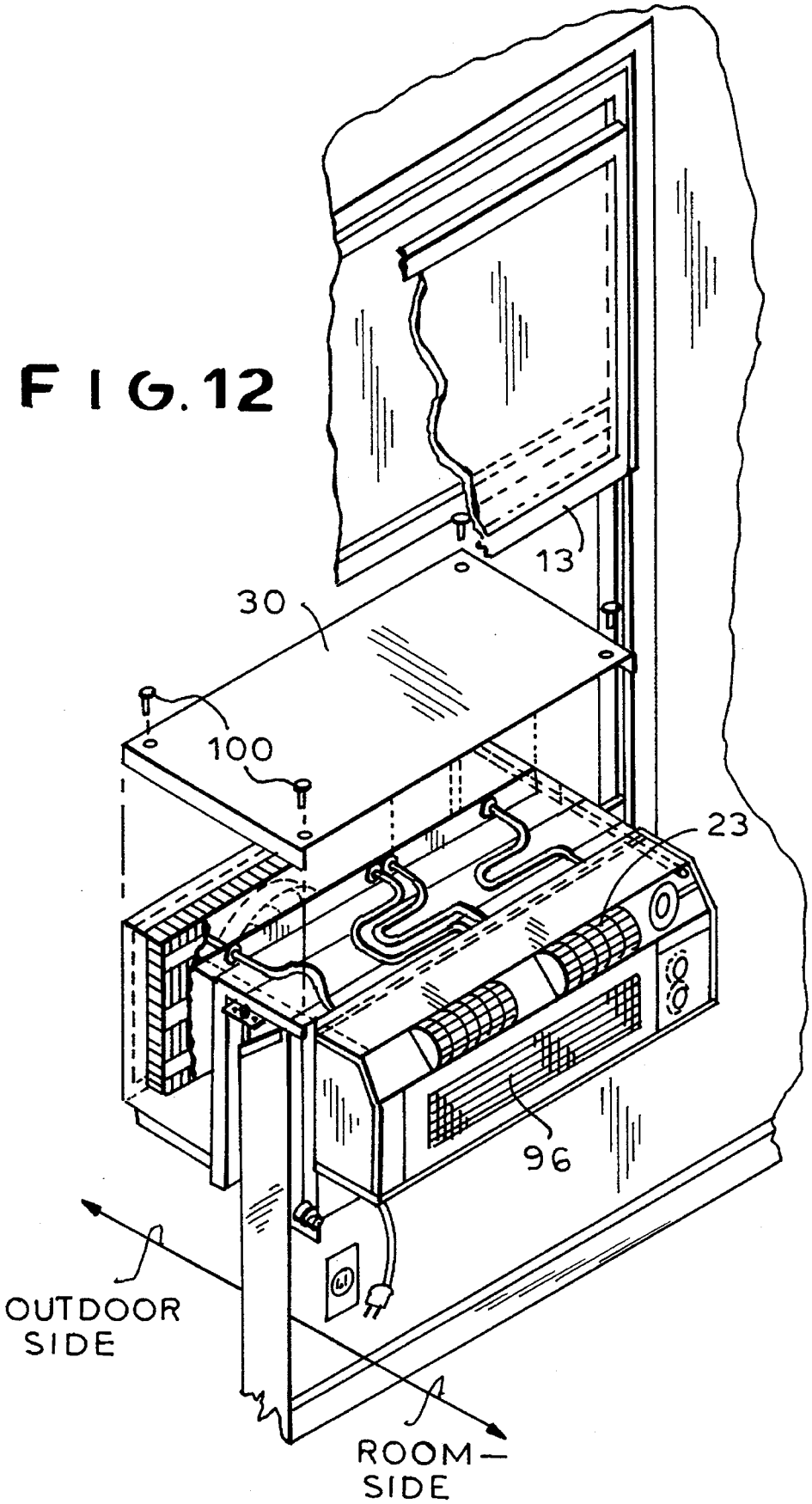
FIG. 12 is a view similar to FIG. 1 but showing the application of the cover plate.

The connectors 85–88 are shown in greater detail for FIG. 10 for the suction refrigerant and the vapor refrigerant tube represented at 81. Both the electric cable 82 and the condensate tube 80 can be provided with loops. The controls 98 seen in FIG. 10, of course, cooperate with the control panel 97 previously described. In FIG. 11, the connectors 83, 85, 86 and 89 are shown to be in place.

After the cover 96 has been snapped in place on the inner unit, a weather seal 99 can be applied, whereupon the cover 30 is attached by screws 100 to complete the installation the seal 25 may then be applied and then the upper sash 13 closed onto that seal (See FIG. 1). Disassembly is, of course, simple as well. The inner unit is removed (after opening the window lower sash 15), by disconnecting the electric plug 28 of the electric cord 33 from the wall electric outlet 27, removing the front cover 96 of the inner unit 22, the weather seal 99, the cover 30 of the outdoor unit 21, disconnecting the electric connector 83, the condensate line 80 and the refrigerant connectors 85 and 86 with virtually no loss of refrigerant. This is followed by removal of the bars whereupon the outer unit can be tilted inwardly and withdrawn.

We claim:

1. A low-obstruction window air conditioner for a window in a wall separating an exterior from an interior, said window having a frame, a lower sash slidable in said frame, a windowsill below said lower sash, said air conditioner comprising:

a saddle bracket adapted to straddle said sill and provided with a substantially horizontal member adapted to rest upon said sill, an outer member extending downwardly from said horizontal member along an exterior of said wall, an inner member extending downwardly from said horizontal member along an interior of said wall, a raisable and lowerable platform guided on said outer member, and jack means operable for raising and lowering said platform on said outer member;

an outer unit comprising an outer casing, a compressor in said outer casing, a condenser in said outer casing and a motor-driven condenser fan in said outer casing, said outer unit being provided with guide means cooperating with guide means on said bracket for guiding said unit onto said platform in a raised position of said platform, whereby operation of said jack means lowers said platform with said outer unit thereon into an operating position of said outer unit;

an inner unit mounted on said bracket and disposed along said inner member, said inner unit comprising an evaporator and a motor-driven blower for blowing air into said interior upon cooling of the air in said evaporator; and refrigerant tubes disposed in said horizontal member and connecting said units.

2. The low-obstruction window air conditioner defined in claim 1, further comprising a pair of bars fitted into said horizontal member, engaging said outer casing in said operative position of said outer casing to secure said outer unit in said operating position, and projecting into the interior beyond said inner member, said inner unit having guides slidably received on said bars for suspending said inner unit from said bars.

3. The low-obstruction window air conditioner defined in claim 2 wherein said guide means on said outer unit includes rollers provided on said outer casing and said guide means on said bracket includes horizontal channels receiving said rollers on said horizontal member and vertical channels connected to said horizontal channels on said outer member.

4. The low-obstruction window air conditioner defined in claim 3 wherein said jack means includes a vertical jack screw receiving an hexagonal key at an upper end thereof.

5. The low-obstruction window air conditioner defined in claim 4, further comprising bracing screws on said inner and outer members for bracing same against said wall, and leveling screws on said horizontal member for leveling same.

6. The low-obstruction window air conditioner defined in claim 4, further comprising a condensate collector below said evaporator and a condensate tube connecting said condensate collector with said outer unit and extending through said horizontal member.

7. The low-obstruction window air conditioner defined in claim 4, further comprising a cover plate overlying said tubes and said horizontal member and secured to said sill.

8. The low-obstruction window air conditioner defined in claim 4, wherein said bars are tubular and of rectangular cross section.

9. The low obstruction window air conditioner defined in claim 1, further comprising a condensate pump in said outer casing.

* * * * *